US005344251A

United States Patent [19]

Erb

[11] Patent Number: 5,344,251

[45] Date of Patent: Sep. 6, 1994

[54] SHEAR PLUG CONNECTOR ARRANGEMENT

[76] Inventor: Anton H. Erb, 37, rue des Clos, CH-2012 Auvernier, Switzerland

[21] Appl. No.: 977,244

[22] Filed: Nov. 16, 1992

[30] Foreign Application Priority Data

Nov. 29, 1991 [CH] Switzerland ..... 3503/91

[51] Int. Cl.[5] ..... E04B 1/00

[52] U.S. Cl. ..... 403/297; 403/220; 52/182

[58] Field of Search ..... 403/297, 220, 221, 225, 403/404, 203; 52/182, 188, 184, 167 EA, 167 R; 267/141, 141.1

[56] References Cited

U.S. PATENT DOCUMENTS

| | | | |
|---|---|---|---|
| 1,743,492 | 1/1930 | Sipe | 403/297 |
| 1,859,038 | 5/1932 | Irgens | 403/297 |
| 2,214,177 | 9/1940 | Raybould | 403/297 |
| 2,904,379 | 9/1959 | Nelson | 403/297 |

FOREIGN PATENT DOCUMENTS

| | | | |
|---|---|---|---|
| 0127631 | 12/1984 | European Pat. Off. . | |
| 2161840 | 6/1973 | Fed. Rep. of Germany . | |
| 2728216 | 1/1979 | Fed. Rep. of Germany | 52/182 |
| 2935781 | 4/1981 | Fed. Rep. of Germany . | |
| 3020141 | 12/1981 | Fed. Rep. of Germany | 52/182 |
| 3024174 | 1/1982 | Fed. Rep. of Germany . | |
| 3120735 | 12/1982 | Fed. Rep. of Germany | 52/182 |
| 3543535 | 4/1987 | Fed. Rep. of Germany . | |
| 3916819 | 11/1990 | Fed. Rep. of Germany . | |
| 596397 | 10/1977 | Switzerland . | |

*Primary Examiner*—Randolph A. Reese
*Assistant Examiner*—Anthony Knight
*Attorney, Agent, or Firm*—Brady, O'Boyle & Gates

[57] ABSTRACT

A shear plug connector arrangement is formed by a bearing element (1) and a plug element (2) that can be introduced into the bearing element. The bearing element (1) comprises an outer sleeve and an inner sleeve (3 and 4, respectively). Between these two sleeves (3, 4), an elastic element (5) is arranged. The inner sleeve (4) and thus the plug element (2) introduced therein are mounted in floating fashion. This leads to a good footstep sound insulation. In accordance with the invention, a structure (7, 8, 9) is provided for limiting motion amplitudes at the bearing element (1) and/or at the plug element (2) so that the elastic element is not subject to excessive stresses and to ensuing short-term or long-term damage. The aforementioned structure is realized, for example, by an annular disk (8) on the front face of the inner sleeve (4), a nail plate (7) having a circular opening at the outer sleeve (3), and an interposed gap (9). The plug element (2) has a good inherent damping since it is constituted by a plug sleeve (11), a plug core (12), and a filling material (13) provided between sleeve and core.

11 Claims, 1 Drawing Sheet

SHEAR PLUG CONNECTOR ARRANGEMENT

FIELD OF ART

The invention relates to a shear plug connector arrangement comprising a plug element to be anchored in a first component and a bearing element to be anchored in a second component wherein the plug element is mounted in floating fashion in the bearing element by means of at least one elastic element.

STATE OF THE ART

In many high-rise buildings, footstep sound insulation presents a very acute problem, especially when it is intended to provide sound insulation of staircases and intermediate ceilings in concrete, steel, brick, or cement block structures against the supporting vertical walls. In order to solve this problem, diverse types of footstep sound insulating units with plug and associated sleeve have been known wherein normally iron or steel plugs of a specific cross section are utilized which latter are embedded fixedly in the end faces of the staircase or the intermediate ceiling and are supported on the other side in a sleeve firmly anchored in the vertical wall. The sleeve is lined with a sound-damping elastic material (rubber, synthetic resin, etc.).

An arrangement of the type mentioned above has been known, for example, from Swiss Patent 596,397. This involves a device for the absorption of shear forces between a fixedly arranged first plate and a second plate lying on the first plate. A bolt cemented into the first plate projects into a sleeve lined with a buffer member and cemented into the second component. Due to the fact that no solid connection exists between the two plates, vibrations are transmitted only in damped fashion from one plate to the other.

The problem in the conventional shear plug connectors with damping element resides in that, in case of strong impacts or dilations, the elastic material in the sleeve must locally absorb very high pressures. As a consequence, the damping effect of these materials, which is good per se, will worsen or will even be entirely lost in the course of time.

SUMMARY OF THE INVENTION

It is an object of the invention to indicate a shear plug connector arrangement of the type discussed hereinabove which avoids the problems existing in the prior art and which is distinguished by high sound insulation.

According to the invention, this object has been attained by providing means for limiting motion amplitudes at the bearing element and/or at the plug element in such a way that the elastic element is not stressed excessively and consequently cannot be subject to short-term or long-term damage.

The basic aspect of the invention thus resides in that means are provided at the bearing element or at the plug element, or at both elements, which preclude, in case of strong motion amplitudes (impacts, dilation), that the entire deflection must be absorbed by the elastic element. Smaller motion amplitudes or, respectively, sound vibrations, can still be absorbed completely by the elastic element so that the sound-damping action remains entirely preserved.

In accordance with a preferred embodiment, the bearing element has an outer sleeve exhibiting, as the elastic element, a lining of an elastic material. Furthermore, the bearing element has an axial cavity with an opening at its front face for receiving the plug element. The means for limiting motion amplitudes are constituted by at least one preferably annular attachment on the front face of the bearing element. The elastic material, providing sound insulation at normal motion amplitudes, is not present in the zone of the aforementioned attachment.

In order to support the plug element in the axial direction in sliding fashion within the bearing element, a sleeve is provided which defines the cavity for accommodation of the plug element. The elastic element is arranged between the inner and outer sleeves. The means for limiting the motion amplitudes are formed on the front face of the two sleeves.

A ring-like, preferably continuous radial gap is provided between the means for limiting the motion amplitudes. The width of the gap is smaller than the (radial) thickness of the elastic element. The gap width defines the maximally possible compression of the elastic element between inner and outer sleeves. Preferably, the means for limiting the motion amplitude comprise radially outwardly and, respectively, radially inwardly projecting extensions and, respectively, flanges which rest, in case of excessive load, on a counter piece (e.g. likewise a flange). In place of flanges, it is also possible to provide several separate ribs, bolts, etc.

In accordance with an especially preferred embodiment, the inner and outer sleeves are of cylindrical shape and are disposed coaxially one within the other. Such a bearing element will absorb or block vibrations or, respectively, impacts or dilations perpendicularly to the longitudinal axis equally well, independently of the directions.

In order to affix the bearing element to a formwork wall for encasing in concrete, a nail plate is advantageously arranged at the front face. This plate can simultaneously embody a part of the amplitude-limiting means.

According to an especially preferred embodiment, the plug element has an external dimensionally stable plug sleeve filled at least in part with a noise-damping filler material. Such a plug element has a higher inherent damping than a monolithic plug, for example of steel. Therefore, sound waves are suppressed, at least partially, even by the plug element proper. In combination with the floating support in the bearing element, a particularly good footstep sound insulating effect is thus obtained.

A further effect of the plug structure in accordance with this invention resides in that the plug has a larger outer diameter than a monolithic design if it is to satisfy the same shear stress, leading to a larger contact surface of the plug element in the bearing element and, respectively, to a lower local stress on the elastic element.

Advantageously, a plug core is embedded in the filler element; this core will still hold the plug connector arrangement together as an emergency measure, particularly in case of breakage of the plug sleeve.

The plug sleeve consists preferably of stainless steel or a similar, durable and stressable material. The plug core can consist of iron or steel. The latter is preferably arranged centrally within the plug sleeve. The annular space between the plug sleeve and the plug core is filled out with the filling material, for example cement.

The plug element according to this invention can, of course, be utilized also independently of the bearing element according to this invention.

Additional advantageous embodiments and feature combinations of the invention result from the detailed description and the claims in their entirety.

BRIEF DESCRIPTION OF THE DRAWINGS

The invention will be described in greater detail below with reference to embodiments and in conjunction with the drawings wherein.

Basically corresponding parts bear identical reference symbols in the figures.

WAYS OF EXECUTING THE INVENTION

Figure 1:
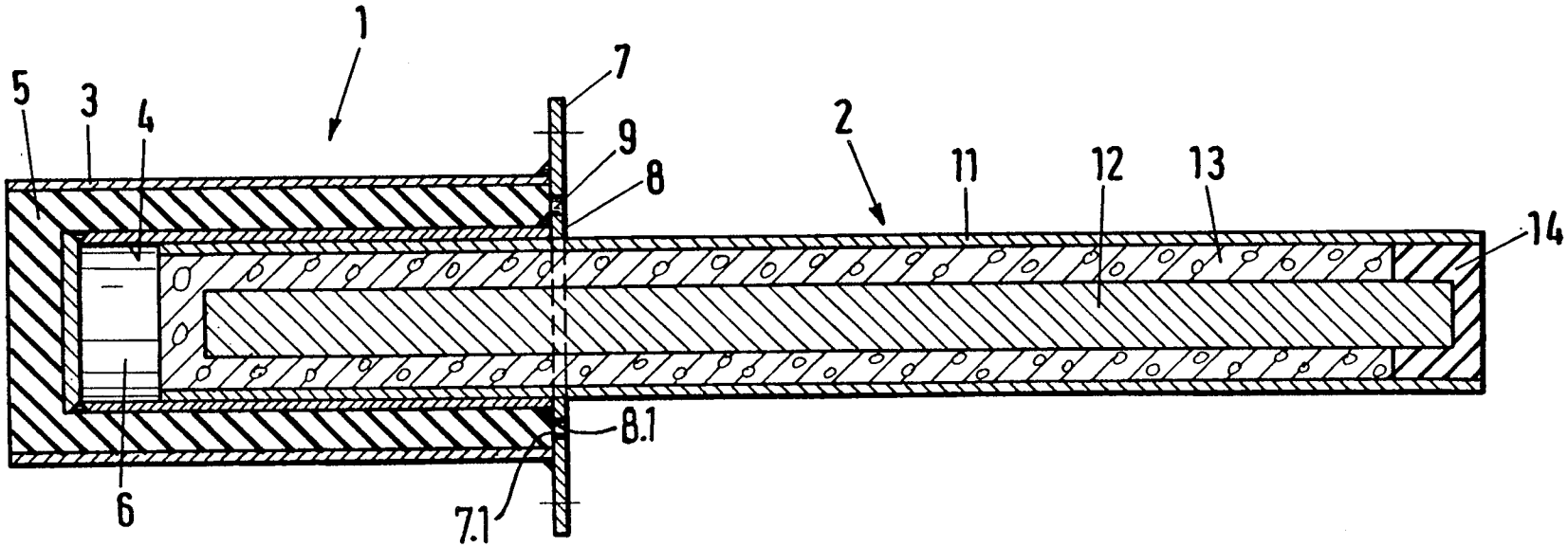
FIG. 1 shows a plug connector arrangement according to this invention in an axial longitudinal section.

FIG. 1 shows the shear plug connector arrangement of this invention in a typical in-use position. A bearing element 1, encased in concrete, for example, in a wall, receives a plug element 2 which latter, in turn, is encased in concrete horizontally, for example, in a ceiling.

The bearing element 1 exhibits a tubular outer sleeve 3 lined with an elastic element 5, e.g. a layer of neoprene, natural rubber, etc. An inner sleeve 4 is embedded in the elastic element 5 coaxially to the outer sleeve 3. The inner sleeve 4 is adapted with respect to its internal cross section to the external cross section of the plug element 2. In other words, the plug element 2 is supported in a cavity 6 of the bearing element 1 with minor clearance and displaceable in the axial direction.

The inner sleeve 4 has a somewhat shorter length than the outer sleeve 3 so that it is covered, at the rearward end of the bearing element to be encased in concrete, by the elastic element 5 also in the axial direction. The inner sleeve 4 and, respectively, the plug element supported therein thus are mounted in floating fashion in the radial as well as axial directions. On account of the absence of any sound-conducting bridges, a very good sound insulation is achieved.

A nail plate 7 is provided on the front face of the bearing element 1. This plate is, for example, square in configuration and has nail holes 10 in the corners for attaching the bearing element 1 to the inside of the formwork during the step of encasing the arrangement in concrete.

According to this invention, the bearing element 1 comprises means for the prevention of motion amplitudes which could damage the elastic element 5 during the course of time. These means involve stop elements mounted in pairs at a suitable mutual distance.

In the present example, an annular disk 8 is attached to the forwardly open front face of the inner sleeve 4. This disk has the same inner diameter as the inner sleeve 4, but forms an abutment 8.1 that projects radially toward the outside past the outer diameter of the inner sleeve 4.

An opposed, spaced apart abutment is formed by the inner rim 7.1 of the nail plate 7. The latter, in accordance with a preferred embodiment, is here provided with a circular opening which latter, in its diameter, is on the one hand somewhat smaller than the inner diameter of the outer sleeve 3 and on the other hand to a predetermined extent larger than the outer diameter of the annular disk 8. Thus, a radial, annular gap 9 is formed between the annular disk 8 and the rim 7.1 of the nail plate 7. The width of this gap is smaller than the radial thickness of the elastic element 5. Therefore, the elastic element 5 cannot be compressed to any extent greater than the width of the gap 9. Larger motion amplitudes are blocked in this way.

The inner and outer sleeves 4 and 3, respectively, consist of a suitable steel, for example. The outer sleeve 3 is shown in the present embodiment as a tube, i.e. without a rearward cover (bottom). In contrast thereto, the inner sleeve 4 has such a bottom at the rearward end, i.e. it is of a can shape. 0f course, also the outer sleeve 3 can be equipped with such a bottom if this is desirable under certain circumstances. Conversely, the sleeve 4 can be designed without a bottom.

The elastic element preferably fills out the entire space between the inner and outer sleeves 4 and 3, respectively. This element can be realized, for example, by rubber having small cavities, the cavities serving for setting a desired elasticity or, respectively, radial spring effect.

The stop elements need not be realized absolutely at the front as an annular disk and a nail plate with an interposed gap. It is also possible, for example, to include stop elements provided at some other axial location. A possible arrangement, though less preferred, resides, for example, in longitudinal ribs with opposed stop surfaces located at regular (azimuthal) distances between the inner and outer sleeves.

The annular disk 8 can also be omitted if, for example, the inner diameter of the opening of the nail plate 7 is chosen to be correspondingly smaller so that either the axially slightly protruding inner sleeve 4 or the plug element 2 proper acts as the amplitude-limiting stop surface. The outer sleeve 3, inner sleeve 4, nail plate 7, and annular disk 8 consist preferably of stainless steel.

The plug element 2 is preferably a composite element of high inherent damping rather than a monolithic steel element as in the state of the art.

A plug core 12 is embedded by means of filling material 13 in a plug sleeve 11. The plug sleeve 11 is, for example, a steel tube of a suitable length. In this tube, an iron rod is arranged coaxially as the plug core 12. The space existing between the plug sleeve 11 and the plug core 12 is filled up, for example, with cement as the filling material 13. At the end of the plug element 2 to be encased in concrete, a peg 14, for example of a synthetic resin, is provided in the plug sleeve 11 and is the centering means for the plug core 12. This peg 14 retains, inter alia, the plug core 12 centrally within the plug sleeve 11 during the step of introducing cement as the filling material in the manufacture of the plug element according to this invention.

The plug element 2 is typically cylindrical and has a length which is twice to three times the length of the cavity 6 of the bearing element 1. In the in-use position, the plug element 2 is typically supported to approximately one-third of its length in the bearing element 1. A small portion of the cavity 6 remains vacant for axial displacements (dilation shifts).

It is advantageous to dimension the plug sleeve 11 in such a way that it is capable of absorbing all shear forces acting on the plug element 2. In the normal case, then, only this part, designed as a steel tube, for example, will be stressed. At the same time, it is recommended to dimension the plug core 12 so that, in case of a possible breakage of the plug sleeve 11, it is likewise capable of absorbing the entire shear forces acting on the shear plug connector. In this way, a safety feature is obtained which is substantially enhanced as compared with conventional units.

The peg 14 can also be omitted in case of suitably chosen manufacturing methods. In place of cement, it is also possible to utilize another hardening material that lends itself to casting. If the additional safety, or respectively strength provided by the plug core 12 is undesirable, then the core can also be eliminated. The plug sleeve 11 is then filled completely with the damping filling material 13.

As mentioned above, a larger diameter of the plug element 2 results in a broader support of the shear stress in the bearing element 1. The elastic material is then subjected less to point-by-point stress. For heavier loads, a double shear plug connector can also be expedient (compare EP-0 127 631 B1).

Figure 2:
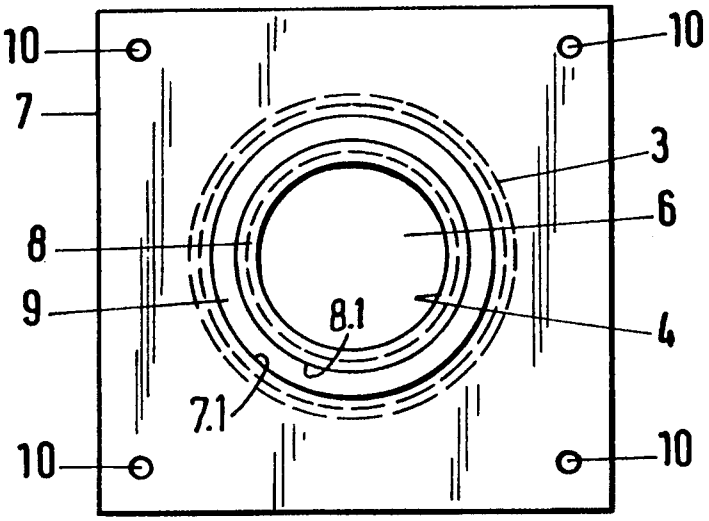
FIG. 2 shows a bearing element as seen from the front side.

The embodiment described with reference to FIGS. 1 and 2 is extensively rotationally symmetrical. If required, it is, of course, also possible to choose other cross-sectional configurations (rectangular, square, hexagonal, etc.).

The plug element 2 need not absolutely be supported in displaceable fashion. Correspondingly, it is not impossible to omit the inner sleeve 4.

In summation, it can be stated that the invention provides a shear plug connector arrangement distinguished by a high sound-insulating efficiency, especially for footstep sound, by a long lifetime, and by increased mechanical safety.

I claim:

1. A shear plug connector assembly comprising, a plug element to be anchored in a first component, a bearing element to be anchored in a second component, an elastic element connected in said bearing element, said plug element mounted in said elastic element whereby said plug element is floatingly mounted in said bearing element by said elastic element, cooperating means connected between said bearing element and said plug element for limiting the motion amplitudes between said plug element and bearing element through said elastic element and said cooperating means operable at greater motion amplitudes to transfer shear force directly between said plug element and bearing element, whereby said elastic element is not excessively stressed and subjected to damage.

2. A shear plug connector assembly as set forth in claim 1, in which said bearing element has an outer sleeve, a front plate connected at one end of said outer sleeve, said elastic element connected in said outer sleeve, cavity means disposed in said elastic element, an opening through said front plate in alignment with said cavity means, said plug element extending through said opening and mounted in said cavity means, and one of said cooperating means annularly surrounding said opening.

3. A shear plug connector assembly as set forth in claim 2, including an inner sleeve defining said cavity means, said inner sleeve having an end adjacent said front plate, said plug element connected in said inner sleeve, said cooperating means formed on said end of said inner sleeve adjacent said front plate and/or at said opening in said front plate.

4. A shear plug connector assembly as set forth in claim 3, in which said inner sleeve and said outer sleeve are cylindrical sleeves and are coaxially connected by said elastic element.

5. A shear plug connector assembly as set forth in claim 2, in which said front plate extends laterally outwardly of said outer sleeve, and connecting apertures in said front plate spaced laterally outwardly from said outer sleeve.

6. A shear plug connector assembly comprising, a plug element to be anchored in a first component, a bearing element to be anchored in a second component, said bearing element having an outer sleeve with a front face, an opening through said front face, an elastic element connected in said outer sleeve, cavity means disposed in said elastic element, said plug element extending through said opening on said front face and mounted in said cavity means whereby said plug element is floatingly mounted in said bearing element by said elastic element, stops associated with said bearing element and said plug element, one of said stops annularly surrounding said opening, and said stops spaced apart by a ring-like continuous gap, whereby the motion amplitudes between said plug element and bearing element are limited so said elastic element cannot be excessively stressed and subjected to damage.

7. A shear plug connector assembly comprising, a plug element to be anchored in a first component, a bearing element to be anchored in a second component, said bearing element having an outer sleeve with a front face, an opening through said front face, an elastic element connected in said outer sleeve, cavity means disposed in said elastic element, said plug element extending through said opening on said front face and mounted in said cavity means whereby said plug element is floatingly mounted in said bearing element by said elastic element, means connected between said bearing element and said plug element for limiting the motion amplitudes therebetween, said means including first flange means defined by said opening and projecting radially inwardly from said outer sleeve, second flange means connected with said cavity means and projecting radially outwardly and spaced from said first flange means, and said first and second flange means movable into contact with each other to limit the motion amplitudes between said bearing element and plug element, whereby said elastic element cannot be excessively stressed and subjected to damage.

8. A shear plug connector assembly comprising, a plug element to be anchored in a first component, a bearing element to be anchored in a second component, an elastic element connected in said bearing element, said plug element mounted in said elastic element whereby said plug element is floatingly mounted in said bearing element by said elastic element, cooperating means connected between said bearing element and said plug element for limiting the motion amplitudes between said plug element and bearing element so said elastic element cannot be excessively stressed and subjected to damage, said plug element having an outer, dimensionally stable plug sleeve, and noise-damping filling material at least partly filling said plug sleeve.

9. A shear plug connector assembly as set forth in claim 8, including a plug core embedded in said filling material.

10. A shear plug connector assembly as set forth in claim 8, in which said plug sleeve is a stainless steel plug sleeve, and said filling material is cement.

11. A shear plug connector assembly as set forth in claim 9, in which said plug sleeve is a stainless steel plug sleeve, said plug core consists of iron, and said filling material is cement.

* * * * *